US007169061B2

(12) United States Patent
Hou

(10) Patent No.: US 7,169,061 B2
(45) Date of Patent: Jan. 30, 2007

(54) PUTTER HEAD

(75) Inventor: Wen-Ching Hou, Kaohsiung (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 61 days.

(21) Appl. No.: 10/759,274

(22) Filed: Jan. 20, 2004

(65) Prior Publication Data

US 2005/0159241 A1 Jul. 21, 2005

(51) Int. Cl.
*A63B 53/04* (2006.01)

(52) U.S. Cl. ..... 473/341

(58) Field of Classification Search ..... 473/341, 473/340, 334–339

See application file for complete search history.

(56) References Cited

U.S. PATENT DOCUMENTS 4,174,108 A * 11/1979 Reinholz ..... 473/247
5,450,894 A * 9/1995 Inoue et al. ..... 165/43
5,890,969 A * 4/1999 Bechler ..... 473/255
6,471,600 B2 10/2002 Tang et al.
6,506,125 B2 * 1/2003 Helmstetter et al. ..... 473/242
6,533,680 B2 * 3/2003 Wu ..... 473/340
6,699,142 B2 * 3/2004 Wu ..... 473/340
2003/0083149 A1 * 5/2003 Scarpa et al. ..... 473/341

* cited by examiner

*Primary Examiner*—Raeann Gorden
(74) *Attorney, Agent, or Firm*—Birch, Stewart, Kolasch & Birch, LLP

(57) ABSTRACT

A putter head includes a body and a light insert. The body includes a face portion, two mass portions, and a connecting portion. The face portion is located on a front side of the body, the mass portions are located on two sides of the body, and the connecting portion is formed between the mass portions for connecting the mass portions, with a compartment being defined between the mass portion and the connecting portion. The light insert is securely mounted in the compartment of the body. The light insert includes at least one aiming mark on a top face thereof. Further, the club head has a center of gravity positioned within the light insert.

18 Claims, 5 Drawing Sheets

PUTTER HEAD

BACKGROUND OF THE INVENTION

1. Field of the Invention

The present invention relates to a putter-type club head. In particular, the present invention relates to a putter-type club head including a light insert for adjusting a center of gravity and an alignment means for aiming a golf ball during putting.

2. Description of Related Art

U.S. Pat. Nos. 6,471,600 and 6,506,125, as illustrated in FIGS. 1 and 2 of the drawings, disclose a putter head comprising a body 10 that includes a face portion 11, a hosel (cylindrical rod) 12, a crown portion 101, a sole portion 102, an aft-mass portion 103, a central aperture 104, and an alignment means 105. The central aperture 105 extends through the body 10 and has a heel opening at a heel end of the body 22 and a toe opening at a toe end of the body 22. The alignment means 105 assist a golfer in properly aiming a golf ball toward a hole when putting. The center of gravity of the club head is positioned within the central aperture 104. The body 10 has an appropriate length "B" and an appropriate width "A". The center of gravity of the club head and the ball striking point on the face portion 11 are located on a line normal to a general plane of the face portion 11 to effectively impart the momentum to the ball, thereby reducing striking error and improving striking accuracy.

Nevertheless, the weights of the crown portion 101 and the aft-mass portion 103 of the body 10 cause the center of the gravity to be located above the ball striking point on the face portion 11. As a result, the line passing through the center of gravity and the ball striking point is at an inclined angle with the ground, not parallel to the ground. The striking accuracy is thus adversely affected. Further, the body 10 having the central aperture 104 can only be manufactured by casting during which shrinkage cavities and cinder holes are easily generated in an inner wall delimiting the central aperture 104. Subsequent processing of the body 10 is difficult, and the qualified product ratio is decreased.

OBJECTS OF THE INVENTION

An object of the present invention is to provide a putter head including a light insert behind a face portion of the body of the putter head, allowing adjustment of the center of gravity of the club head. The putter head also includes an alignment means behind the face portion, assisting a golfer in properly aiming a golf ball toward a hole when putting. Thus, the striking error is reduced and the striking accuracy is improved. Further, the club head provides increased inertia moment, increasing the striking stability.

SUMMARY OF THE INVENTION

In accordance with an aspect of the present invention, a putter head includes a body and a light insert. The body includes a face portion, two mass portions, and a connecting portion. The face portion is located on a front side of the body, the mass portions are located on two sides of the body, and the connecting portion is formed between the mass portions for connecting the mass portions, with a compartment being defined between the mass portion and the connecting portion. The light insert is securely mounted in the compartment of the body. The light insert includes at least one aiming mark on a top face thereof. Further, the club head has a center of gravity positioned within the light insert.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
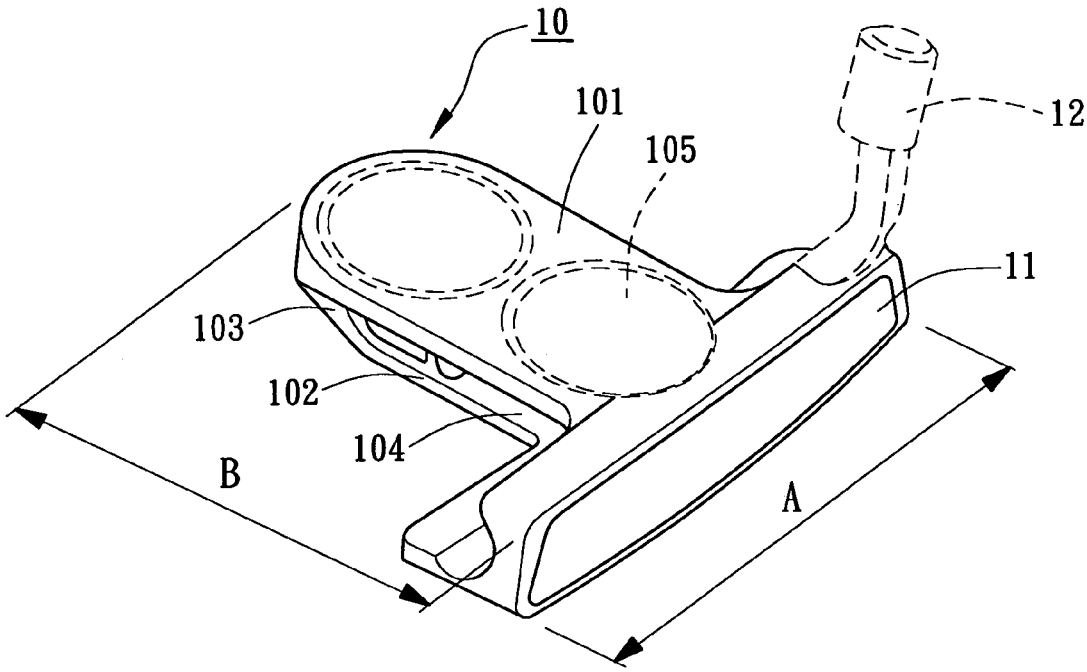
FIG. 1 PRIOR ART
FIG. 1 is a perspective view of a conventional putter-type club head.
Figure 2:
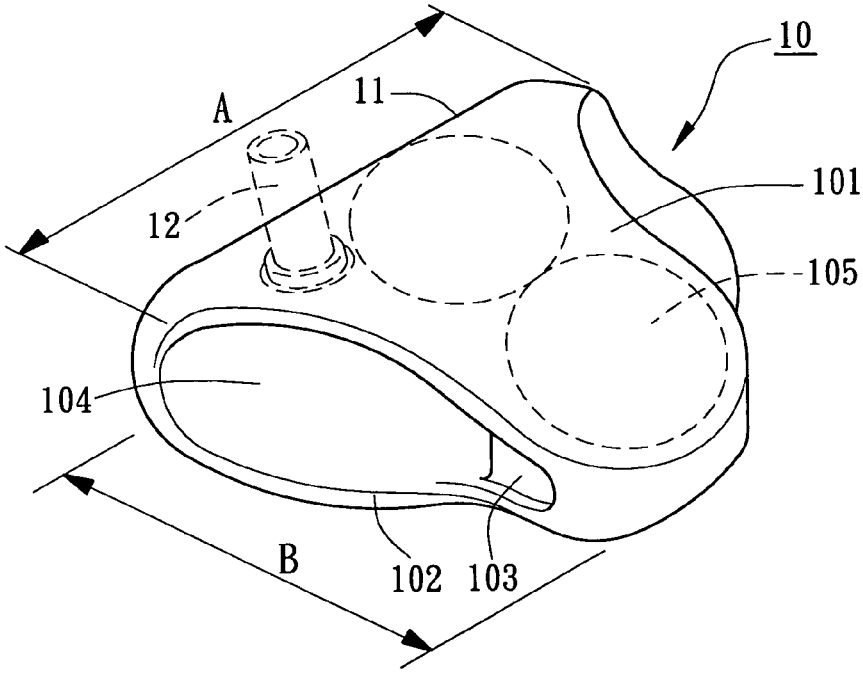
FIG. 2 PRIOR ART
FIG. 2 is a perspective view of another conventional putter-type club head.

Preferred embodiments of the present invention are now to be described hereinafter in detail, in which the same reference numerals are used in the preferred embodiments for the same parts as those in the prior art to avoid redundant description.

Figure 3:
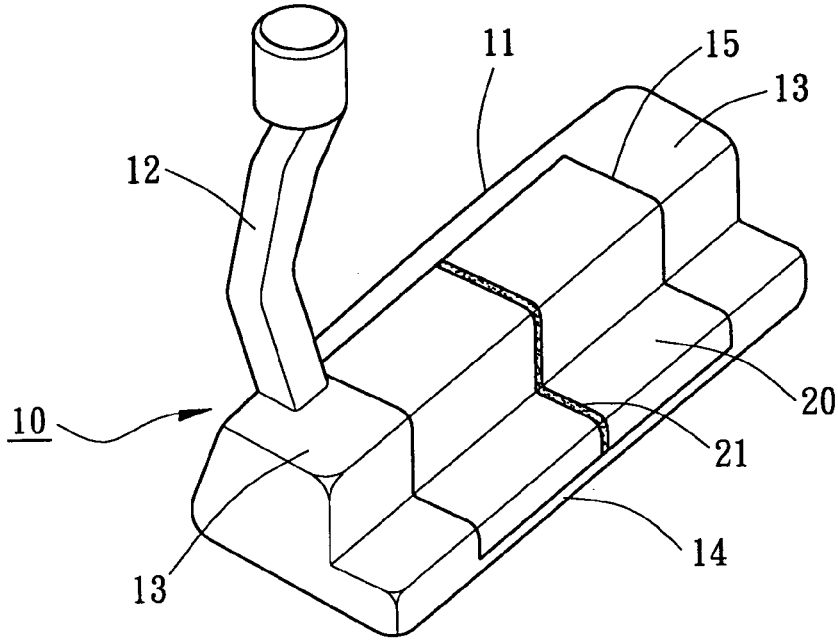
FIG. 3 is a perspective view of a first embodiment of a putter head in accordance with the present invention.
Figure 4:
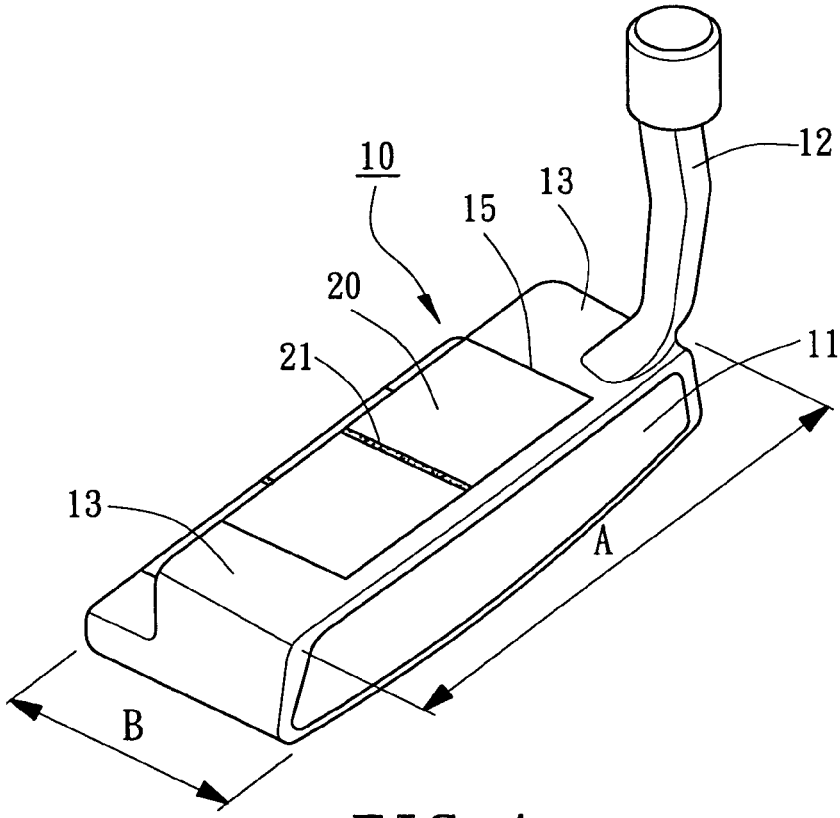
FIG. 4 is another perspective view of the putter head in FIG. 3.
Figure 5:
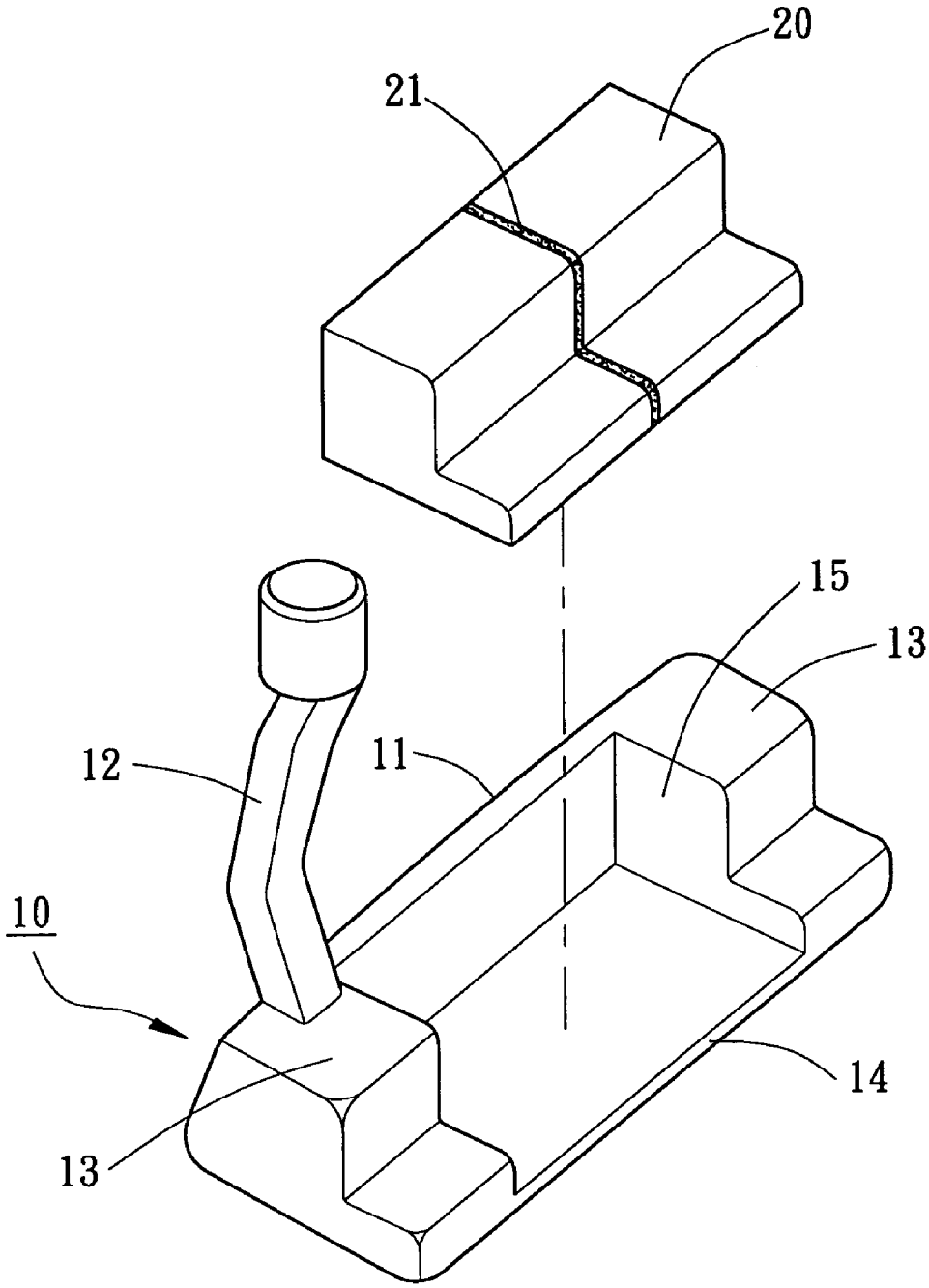
FIG. 5 is an exploded perspective view of the putter head in FIG. 3.

Referring to FIGS. 3 through 5, a first embodiment of a putter head (i.e., putter type club head) in accordance with the present invention comprises a body 10 and a light insert 20. The body 10 is a putter-type body and made of stainless steel, carbon steel, titanium alloy, or copper alloy. The body 10 includes a face portion 11, a hosel 12, two mass portions 13, a connecting portion 14, and a compartment 15. The face portion 10 is located on a front side of the body 10 for striking a golf ball (not shown). The hosel 12 is located on an end of the top side of the body 10 for engaging with a shaft (not shown).

The mass portions 13 are preferably L-shaped and located on two sides of the body 10 and contribute to the weight of the body 10. The connecting portion 14 provides connection between the mass portions 13 to provide the club head with increased inertia moment. The connecting portion 14 has a thickness smaller than 2 mm, preferably smaller than 1 mm, and is most preferably 0.5 mm. The connecting portion 14, the face portion 11, and the mass portions 13 together define the compartment 15 that has a rear open end for engaging with the light insert 20 through an appropriate means.

The light insert 20 is made of a light material having a density smaller than that of the body 10, such as polyurethane (PU), carbon fiber, epoxy, rubber, thermoplastic elastomer, natural high molecular polymers, or synthetic high molecular polymers. Further, the light insert 20 includes an alignment means on a top face thereof. The alignment means includes at least one aiming mark 21 for assisting a golfer in properly aiming a golf ball toward a hole when putting. Formation of the aiming mark 21 will be described in detail later. The aiming mark 21 is rectilinear or arrow-shaped for providing a convenient aiming aid. The width "A" of the body 10 is greater than the length "B" of the body 10. Further, the face portion 11 between the mass portions 13 has a thickness smaller than 2 mm, preferably smaller than 1 mm, and most preferably is 0.5 mm.

The light member 20 can be bonded to the body 10 by preformation, heat pressing formation, or injection molding. As illustrated in FIG. 5, the light insert 20 can be preformed in a mold (not shown) and then bonded by glue to an inner wall face delimiting the compartment 15 of the body 10. The top face of the light insert 20 is printed to provide an aiming mark 21 having a desired color. Alternatively, a material the same as that for the material of the light insert yet with a different color can be added into the material of the light insert 20 while molding the light insert 20.

Figure 6:
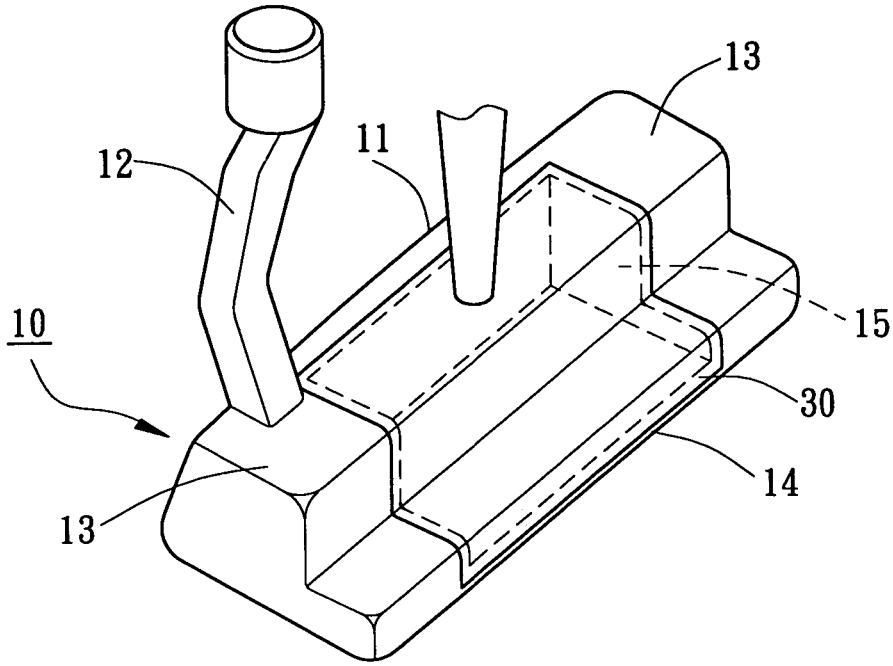
FIG. 6 is a perspective view illustrating a process of manufacturing the putter head in accordance with the present invention.

As illustrated in FIG. 6, the compartment 15 of the body 10 is covered by a moldboard 30, and the material of the light insert 20 is filled or injected into the moldboard 30. Thus, the light insert 20 can be directly bonded to the inner wall face delimiting the compartment 15. Next, the top face of the light insert 20 is printed to provide an aiming mark 21 having a desired color.

Referring to FIGS. 3 and 4, by means of relative location between the mass portions 13 and the light insert 20, the center of gravity of the club head is positioned within the light insert 20 and thus aligned with the aiming mark 21. Further, the center of gravity of the club head and the ball striking point on the face portion 11 are on the same level. Thus, when puttering, the user may aim the golf ball with the aiming mark 21, and the momentum from the club head can be effectively imparted to the golf ball through the ball striking point. The striking error is reduced and the striking accuracy is improved. The body 10 has a simple structure and thus can be manufactured by various processes while increasing the qualified product ratio. More specifically, the club head can be integrally made by precision casting, casting, mechanical processing, pressure casting, forging, or injecting molding. Alternatively, the club head can be manufactured by section-by-section engagement. Further, the face portion 11 has a thickness smaller than 2 mm, which improves the resilient deformation capability of the face portion 11.

Figure 7:
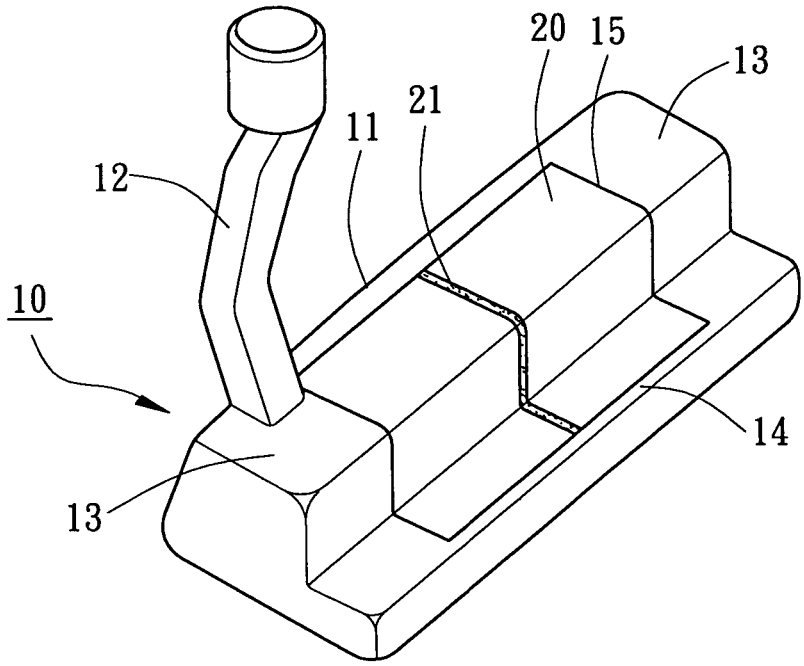
FIG. 7 is a perspective view of a second embodiment of the putter head in accordance with the present invention.

FIG. 7 illustrates a second embodiment of the putter head in accordance with the present invention. In this embodiment, a rear end of the compartment 15 extends upward to prevent the light insert 20 from disengaging from the body 10 via the rear side of the compartment 15. Thus, the bonding reliability of the light insert 20 in the compartment 15 is improved.

Figure 8:
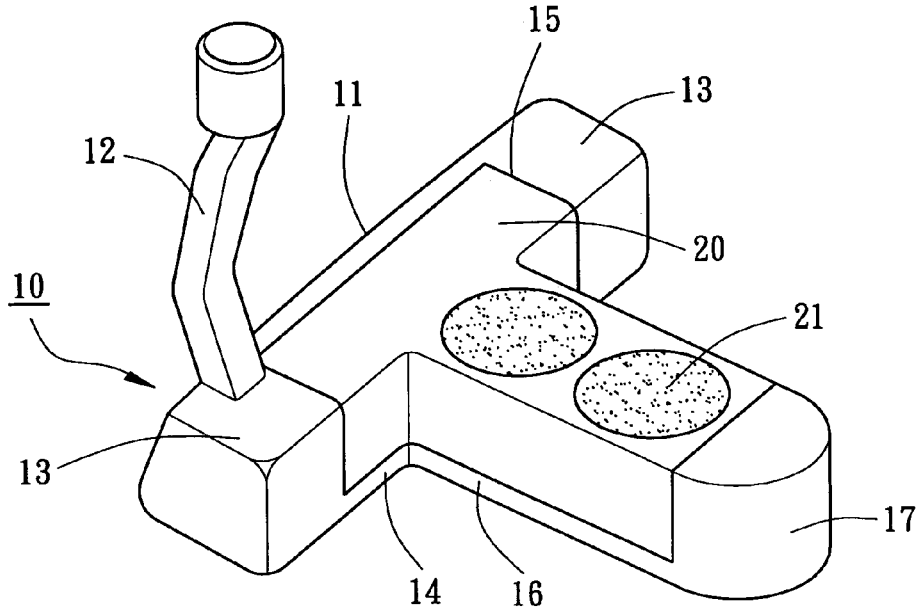
FIG. 8 is a perspective view of a third embodiment of the putter head in accordance with the present invention.
Figure 9:
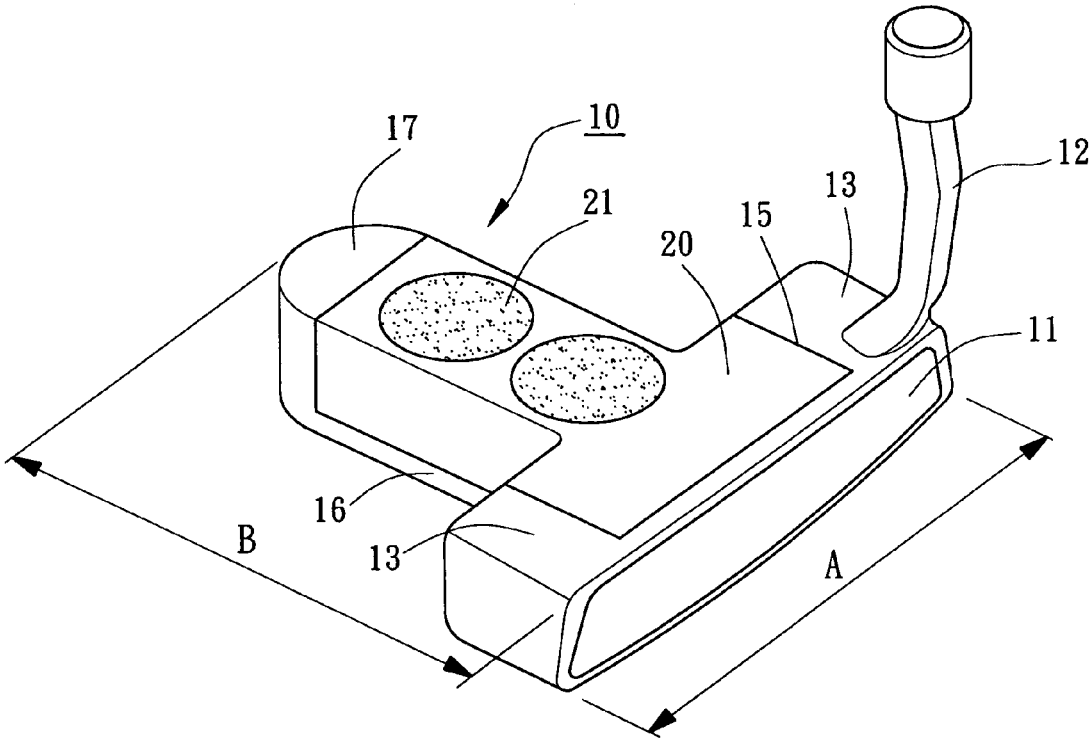
FIG. 9 is another perspective view of the third embodiment of the putter head in accordance with the present invention.

FIGS. 8 and 9 illustrate a third embodiment of the putter head in accordance with the present invention. In this embodiment, the connecting portion 14 includes an extension 16 extending rearward therefrom, with an aft-mass portion 17 being formed on a rear end of the extension 16, providing a substantially T-shaped body 10. Preferably, the width "A" of the body 10 is greater than the length "B" of the body 10. Further, the light insert 20 includes at least one aiming mark 21 on a top face thereof. The aiming mark 21 may be rectilinear, arrow-shaped, circular, oval, or triangular. Thus, the center of the club head is positioned within the light insert 20 through arrangement of the body 10 and the light insert 20. The center of gravity of the club head of this embodiment is located behind that of the club head of the previous embodiments. Further, the triangular mass distribution of the mass portions 13 and the aft-mass portion 17 of the body 10 provides the putter head with increased inertia moment, further improving the striking stability. Further, the center of gravity is aligned with the aiming mark 21, and the center of gravity of the club head and the actual ball striking point on the face portion 11 are on the same level, thereby reducing striking error and improving striking accuracy.

In view of the foregoing, the drawbacks including high center of gravity and shrinkage cavities and cinder holes generated in the manufacturing process of the conventional putter heads are obviated and/or mitigated by the putter head in accordance with the present invention. It is achieved by properly locating the light insert 20 and the aiming mark 21 to simplify the structure of the club head. The striking error is reduced and the striking accuracy is improved.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A putter-type club head, comprising:

a body including a face portion, two mass portions, and a connecting portion, the face portion being located on a front side of the body, the mass portions being located on two sides of the body, the connecting portion being formed between the mass portions for connecting the mass portions, with a compartment being defined between the mass portion and the connecting portion; and a light insert securely mounted in the compartment of the body and made of a material having a density smaller than that of the body, said material selected from the group consisting of carbon fiber, polyurethane, epoxy, rubber, thermoplastic elastomer, and high molecular polymers, the light insert including at least one aiming mark on a top face thereof, the club head having a center of gravity positioned within the light insert.

2. The putter-type club head as claimed in claim 1, wherein the connecting portion has a thickness smaller than 2 mm.

3. The putter-type club head as claimed in claim 1, wherein said at least one aiming mark is one of rectilinear, arrow-shaped, circular, oval, and triangular.

4. The putter-type club head as claimed in claim 1, wherein the connecting portion includes an extension extending rearward therefrom.

5. The putter-type club head as claimed in claim 4, wherein the extension includes an aft-mass portion on a rear end thereof.

6. The putter-type club head as claimed in claim 1, wherein the body has a width greater than a length of the body.

7. The putter-type dub head as claimed in claim 1, wherein the compartment of the body has a rear open end.

8. The putter-type club head as claimed in claim , wherein the compartment of the body has a rear end extending upward.

9. The putter-type club head as claimed in claim 1, wherein the face portion between the mass portions has a thickness smaller than 2 mm.

10. A putter-type club head, comprising:

a body including a face portion, two mass portions, and a connecting portion, the face portion being located on a front side of the body, the mass portions being located on two sides of the body, the connecting portion being formed between the mass portions for connecting the mass portions, with a compartment being defined between the mass portion and the connecting portion; and a light insert securely mounted in the compartment of the body, the light insert including at least one aiming mark on a top face thereof, the club head having a center of gravity positioned within the light insert;

wherein one of the connecting portion and the face portion between the mass portions has a thickness smaller man 2 mm.

11. The puffer-type club head as claimed in claim 10, wherein said at least one aiming mark is one of rectilinear, arrow-shaped, circular, oval, and triangular.

12. The putter-type club head as claimed in claim 10, wherein the connecting portion includes an extension extending rearward therefrom.

13. The putter-type club head as claimed in claim 12, wherein the extension includes an aft-mass portion on a rear end thereof.

14. The putter-type club head as claimed in claim 10, wherein the body has a width greater than a length of the body.

15. The putter-type club head as claimed in claim 10, wherein the compartment of the body has a rear open end.

16. The putter-type club head as claimed in claim 10, wherein the compartment of the body has a rear end extending upward.

17. The putter-type club head as claimed in claim 10, wherein the light insert is made of a material having a density smaller than that of the body.

18. The putter-type club head as claimed in claim 17, wherein the material of the light insert is selected from the group consisting of carbon fiber, polyurethane, epoxy, rubber, thermoplastic elastomer, and high molecular polymers.

* * * * *